US006895205B2

(12) United States Patent
Nakamura et al.

(10) Patent No.: US 6,895,205 B2
(45) Date of Patent: May 17, 2005

(54) IMAGE FIXING APPARATUS WITH COOLING UNIT AND IMAGE FIXING METHOD

(75) Inventors: Masaki Nakamura, Minamiashigara (JP); Toshimizu Ozawa, Minamiashigara (JP); Yoshinari Ueno, Minamiashigara (JP); Norihito Fukushima, Minamiashigara (JP); Hirokazu Hamano, Minamiashigara (JP); Yuka Ishihara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 16 days.

(21) Appl. No.: 10/462,594

(22) Filed: Jun. 17, 2003

(65) Prior Publication Data

US 2004/0022562 A1 Feb. 5, 2004

(30) Foreign Application Priority Data

Jul. 17, 2002 (JP) ..... 2002-207907

(51) Int. Cl.[7] ..... G03G 15/20

(52) U.S. Cl. ..... 399/328; 219/216; 399/324; 399/329; 430/109.1

(58) Field of Search ..... 399/328, 329, 399/320, 324, 325, 333, 331; 219/216; 430/142, 109.1; 347/156

(56) References Cited

U.S. PATENT DOCUMENTS 4,842,944 A * 6/1989 Kuge et al. ..... 219/216
6,006,052 A * 12/1999 Kamimura et al. ..... 399/328
6,463,252 B2 * 10/2002 Omoto et al. ..... 399/328
2002/0154923 A1 * 10/2002 Baker et al. ..... 399/237
2003/0054280 A1 * 3/2003 Ishihara et al. ..... 430/124
2003/0063916 A1 * 4/2003 Katayanagi et al. ..... 399/328

FOREIGN PATENT DOCUMENTS

| | | | |
|---|---|---|---|
| JP | A 63-262671 | | 10/1988 |
| JP | A 4-216579 | | 8/1992 |
| JP | A 4-216580 | | 8/1992 |
| JP | 04-308868 | * | 10/1992 |
| JP | A 4-324476 | | 11/1992 |
| JP | 04-340577 | * | 11/1992 |
| JP | A 5-80666 | | 4/1993 |
| JP | 2000-122464 | * | 4/2000 |
| JP | 2001-117394 | * | 4/2001 |
| JP | 2001-201979 | * | 7/2001 |
| JP | 2002-006656 | * | 1/2002 |
| JP | A 2002-72557 | | 3/2002 |
| JP | 2002-207316 | * | 7/2002 |
| JP | 2003-029463 | * | 1/2003 |

* cited by examiner

*Primary Examiner*—Sophia S. Chen
(74) *Attorney, Agent, or Firm*—Oliff & Berridge, PLC

(57) ABSTRACT

An image fixing apparatus and an image forming method capable of favorably fixing a toner containing a crystalline resin are provided. The image forming apparatus passes a transfer medium having unfixed images formed of the toner containing a crystalline resin between a heating member and a pressurizing member, thereby fixing the unfixed images, using a cooling unit that controls a surface temperature of the pressurizing member in which the surface temperature is controlled to a melting point of the crystalline resin +30° C. or lower.

20 Claims, 1 Drawing Sheet

IMAGE FIXING APPARATUS WITH COOLING UNIT AND IMAGE FIXING METHOD

BACKGROUND OF THE INVENTION

1. Field of the Invention

Figure 1:
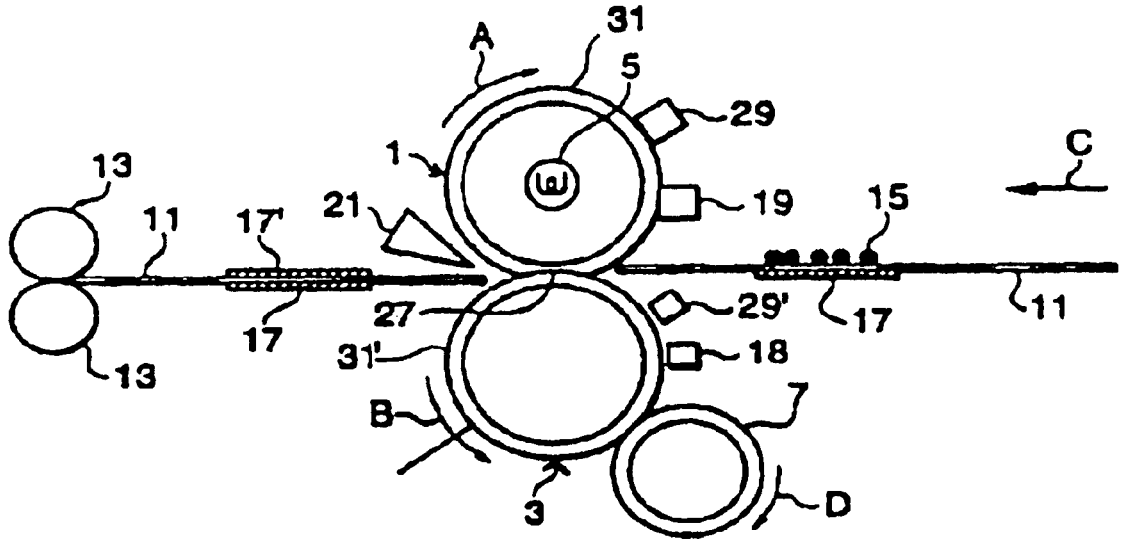

This invention concerns an image fixing method and an image fixing method and, more particularly, it relates to an image fixing apparatus and an image fixing method used for equipment utilizing an electrophotographic process for use in copying machines, printers and facsimiles and, more in particular, color copying machines.

2. Description of the Related Art

In the electrophotographic process, fixed images are formed by way of plural steps of electrically forming latent images by various units on a light sensitive body utilizing a photoconductive material, developing the latent images by use of a toner, transferring latent toner images on the light sensitive body by way of or not by way of an intermediate transfer body to a transfer medium such as paper as toner images and then fixing the transferred images on the transfer medium. In recent years, along with development of equipment and repletion of communication networks in the information society, the electrophotographic process has been utilized not only in copying machines but also generally in office network printers, printers for personal computers, and printers for on-demand printing. Then, high image quality, high operation speed, high reliability, reduction in the size and weight, and energy saving performance have been demanded more and more irrespective of black and white or color printing.

Particularly, demands for coloration and energy saving performance have increased in recent years.

As a contact type fixing method used generally for the fixing method, a method of utilizing heat and pressure at fixing (hereinafter referred to as "heat pressing method") is used generally. In the case of the heat pressing method, since the surface of a fixing member and toner images on a transfer medium are in contact with each other under pressurization, the heat efficiency is excellent and fixing can be conducted rapidly, which is particularly effective in high speed electrophotographic copying machines.

The fixing temperature performance of the toner contributes significantly to the energy saving performance, and the method of using a crystalline resin for a binder resin is excellent in the low temperature fixing property which is described, for example, in Japanese Laid Open Patent Application No. 2002-72557.

However, while the crystalline resin is melted sharply upon temperature elevation in fixing and can be fixed at a low temperature, it has a nature of less solidifying after fixing. Accordingly, it involves a problem of tending to suffer from damages by a releasing member. Further, in the both-face color printing, since molten toners in plural layers are peeled in the image peeling upon color fixing, it is more difficult than the peeling in the black single layer toner and, accordingly, it adopts a mechanism of conducting peeling preferentially to the heating side, that is, the discharging direction is nearer to the pressurizing member and, as a result, it involves a problem that images on the rear face tends to be roughened upon both-face printing.

Inventions described, for example, in Japanese Laid Open Patent Application Nos. H4-216579, S6-3262671, H4-216580, H4-324476 and H5-80666 concern image fixing apparatuses that use belts on the heating side, but when a toner using a crystalline resin is fixed, roughening easily occurs in the images on the rear face although roughness less frequently occurs in the images on the heating surface, to result in a problem in view of the reliability.

SUMMARY OF THE INVENTION

For solving the problems described above, the present invention intends to provide an image fixing apparatus for toners for electrophotography also suitable to color toners, as well as an image fixing method using the apparatus. That is, the invention intends to provide an image fixing apparatus and an image fixing method capable of favorably fixing a toner containing a crystalline resin.

The present inventors, taking notice on the fixing phenomenon of the crystalline resin-containing toner, have made an earnest study and, as a result, have accomplished the invention based on the finding that a suitable range is present for the temperature of images upon fixing and the temperature for fixed images on the rear face, and a toner containing a crystalline resin capable of low-temperature fixing can be fixed with reduced energy and at high reliability.

According to one aspect of this invention, an image fixing apparatus has a heating member, a pressurizing member, and a cooling unit which controls a surface temperature of the pressurizing member, wherein a transfer medium having a fixed image formed of a color toner containing a binder resin that contains a crystalline resin and a colorant on one surface thereof and having an unfixed image formed of a color toner containing a binder resin that contains a crystalline resin and a colorant on another surface thereof is passed between the heating member and the pressurizing member to fix the unfixed image.

According to another aspect of this invention, a method of fixing an image includes the steps of: fixing a toner image formed on one surface of a transfer medium by an apparatus having a heating member and a pressurizing member, the toner image formed of a color toner containing a binder resin that contains a crystalline resin and a colorant; and fixing a toner image formed on another surface of the transfer medium by the apparatus having the heating member and the pressurizing member, the toner image formed of a color toner containing a binder resin that contains a crystalline resin and a colorant, wherein a surface temperature of the pressurizing member is controlled so as to be at a melting point of the crystalline resin +30° C. or lower.

Generally, in the both-face color printing, since the discharging angle of the transfer medium is defined such that the preference is given to the peeling property of the images from the heating member, the peeling property of the images at the rear face from the pressurizing member is poor. In a case of a color toner that contains a crystalline resin, since the change of viscosity during melting is greater than that of the toner using the amorphous resin, when it is adhered under melting, the peeling property from the pressurizing member is worsened to result in unevenness in the gloss caused by peeling failure. The melting of the toner images on the rear face can be suppressed substantially to restrict the unevenness in the degree of gloss due to peeling failure by use of the cooling unit that controls the surface temperature of the pressurizing member thereby controlling the surface temperature of the pressurizing member to a predetermined temperature.

DESCRIPTION OF THE ACCOMPANYING DRAWINGS

Figure 2:
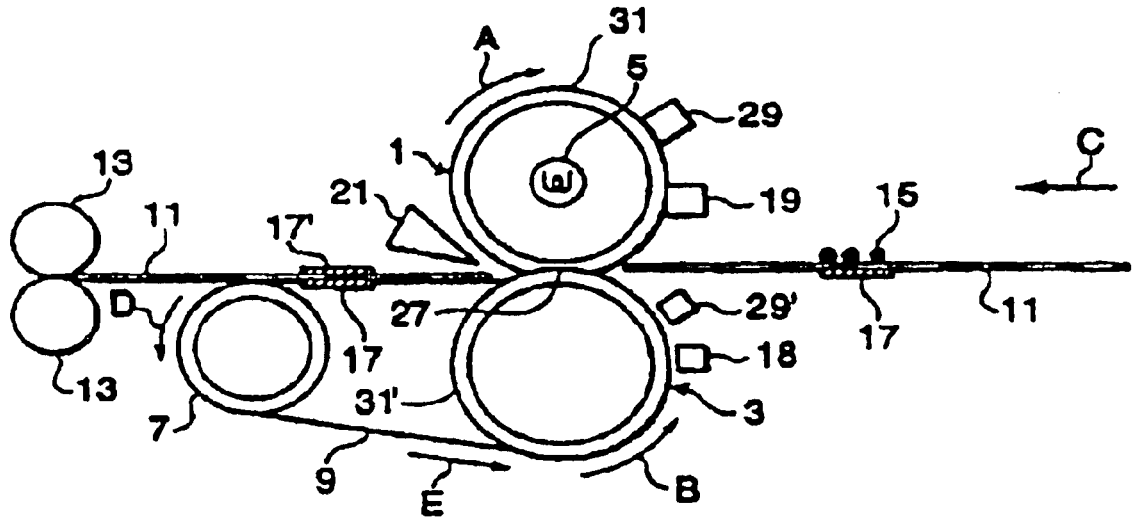

Preferred embodiments of the present invention will be described in detail based on the drawings, wherein:

FIG. 1 is a schematic constitutional view of an image fixing apparatus according to the present invention using a cooling roll as a cooling unit; and FIG. 2 is a schematic constitutional view of an image fixing apparatus according to the present invention using a cooling belt as a cooling unit.

PREFERRED EMBODIMENTS OF THE INVENTION

The present invention provides an image fixing apparatus for passing a transfer medium having, on one surface, fixed images formed of a color toner for electrophotography containing a binder resin that contains a crystalline resin and having, on the other surface, unfixed images formed of a color toner for electrophotography containing a binder resin that contains a crystalline resin and a colorant between a heating member and a pressurizing member, thereby fixing the unfixed images, in which a cooling unit for controlling the surface temperature of the pressurizing member is provided.

In a case of fixing unfixed images of the transfer medium having, on one surface, fixed images formed of a color toner for electrophotography containing a binder resin that contains a crystalline resin and a colorant and having, on the other surface, unfixed images by a heat pressing method, images are usually fixed by heating the surface. In this case, it is preferred that the surface having the fixed images is not heated exceeding a predetermined temperature in order not to cause image defects such as unevenness in the degree of gloss due to remelting of the binder resin. Since the image fixing apparatus according to the invention includes the cooling unit for controlling the surface temperature of the pressurizing member, heating on the surface having the fixed images can be suppressed.

FIG. 1 shows an image fixing apparatus according to the present invention.

The image fixing apparatus according to the invention shown in FIG. 1 includes a heating roll 1 as a heating member, a pressurizing roll 3 as a pressurizing member arranged in press contact with the heating roll 1, a cooling roll 7 as a cooling unit arranged in contact with the pressurizing roll 3, a temperature sensor 19 disposed on the surface of the heating roll 1, a temperature sensor 18 disposed on the surface of the pressurizing roll 3, a heating lamp 5 disposed inside the heating roll 1 and a finger 21 in which a fixing nip 27 is formed to a press contact portion by arrangement of the heating roll 1 and the pressurizing roll 3 in press contact to each other.

In the image fixing apparatus in FIG. 1, the heating roll 1 and the pressurizing roll 3 are rotated in the direction of an arrow A and in the direction of an arrow B, respectively. The heating roll 1 is heated by the heating lamp 5. The surface temperature of the heating roll 1 is also monitored by the temperature sensor 19 to control a temperature suitable to the fixing of the toner.

The surface of the pressurizing roll 3 is cooled by the cooling roll 7 and the surface temperature is controlled to the melting point of the crystalline resin color toner +30° C. or lower. In a case where the transportation speed of the transfer medium (hereinafter referred to as a transfer medium) is less than 160 mm/sec, the surface temperature is preferably at a melting point of the crystalline resin in the color toner +Y° C. or lower in which Y is represented by the following general formula:

$$Y=0.3X-18$$

where X represents the transportation speed (mm/sec) of the transfer medium of the image fixing apparatus.

By setting the temperature on the surface of the pressurizing roll 3 to a range described above, melting of the crystalline resin can substantially be retained. Particularly, in a case where the transportation speed for the transfer medium is slow, the member is heated as far as the rear face to sometime increases the temperature. Accordingly, it has been experimentally found that lower temperature is effective for preventing the roughening of the images.

The surface temperature of the pressurizing roll 3 controlled by the cooling roll 7, that is, the surface temperature of the pressurizing member referred to in the image forming method according to the invention means a temperature immediately after passing the transfer medium continuously by 99 sheets. The surface temperature of the pressurizing member before paper passing does not matter.

A transfer medium 11 having, on one surface, fixed images formed of a color toner for electrophotography and having, on the other surface, unfixed images 15 formed of a color toner for electrophotography is transported by an unillustrated transportation unit in the direction of an arrow C. The transported transfer medium 11 passes through the fixing nip 27. In this process, the unfixed images 15 are in press contact with the surface of the heating roll 1 heated by the heating lamp 5 and melted. The unfixed images 15 in a molten state solidify after the passage of the transfer medium 11 through the fixing nip 27 and fixed on the transfer medium 11 to form fixed images 17'. Further, since the surface of the pressurizing roll 3 is controlled to the melting point of the crystalline resin in the color toner for electrophotography +30° C. or lower by the cooling roll 7, the fixed images 17 are not substantially melted upon passage of the transfer medium 11 through the fixing nip 27 and image failure such as unevenness of gloss does not occur. Particularly preferably, the temperature is at a melting point of the crystalline resin in the color toner +Y° C. or lower in a case where the transportation speed of the transfer medium is less than 160 mm/sec in which Y is represented by the following formula:

$$Y=0.3X-18$$

where X denotes a transfer medium transportation speed (mm/sec) of the image fixing apparatus.

Subsequently, the transfer medium 11 is discharged by the paper discharging conveyor roll 13.

The finger 21 has a function of assisting peeling of the transfer medium 11 adhered to the surface of the heating roll 1 in the fixing nip 27.

For the heating roll 1, those having a rubber elastic layer 31 of a single layered or laminated structure and a releasing layer successively on a metal roll core can be used.

For the metal roll core, a material excellent in heat resistance, having large strength to the deformation and having good heat conductivity is selected and, for example, aluminum, iron, copper or the like can be used. Among them, aluminum or iron is preferred.

The thickness of the rubber elastic layer is, preferably, from 0.1 mm to 3 mm and, particularly preferably, from 0.3 mm to 2 mm. Materials having heat resistance such as silicone rubber and fluoro rubber can be used, and the rubber hardness is, preferably, 70° (JIS-A) or less, particularly preferably 60° or less.

As the material for the peeling layer, those materials of low surface energy such as silicone rubber, fluoro rubber, fluoro latex and fluoro resin are used. Among them, use of the fluoro resin can provide fixing performance of high reliability for a long period of time.

As the fluoro resin, soft fluoro resin containing Teflon(R) such as PFA (perfluoroalkoxy ethyl ether copolymer) and vinylidene fluoride can be used. Since the fluoro resin, compared with the silicone rubber or fluoro rubber, causes no deposition such as toner contamination or lowering of the releasability by adherence or deposition of toner contamination, the life of the heating roll 1 can be extended.

A heating lamp 5 such as a halogen lamp is disposed inside the heating roll 1 and the unfixed images 15 are melted by the heat supplied from an heating lamp 5 and fixed to the transferred material member 11.

As the pressurizing roll 3, those having a releasing layer on a metal roll core can be used and a rubber elastic layering 31' may be provided between the core and the releasing layer. Specific examples of them are identical with those of the heating roll 1.

When the rubber elastic layer of the heating roll is excessively thick exceeding 3 mm, it is not preferred since the heat capacity of the heating roll 1 increases to take a long time for heating the heating roll 1 to a desired temperature, as well as the consumption energy also increases. On the other hand, when the thickness of the rubber layer is excessively small as less than 0.1 mm, it is not preferred since deformation on the surface of the roll cannot conform the unevenness of the unfixed images 15 to cause uneven melting and strains in the rubber elastic layer effective to the peeling cannot be obtained.

Various kinds of additives may be incorporated, depending on the purpose, to the rubber elastic layer and/or releasing layer of the heating layer 1 and the pressurizing roll 3 and they can include, for example, carbon black, metal oxides or particles of ceramic such as SiC with an aim of improving the abrasion resistance and controlling the resistance value.

The cooling roll 7 has a hollow metal roll core as the constituent element. The same material as the heating roll 1 can be used for the metal roll core.

The cooling roll 7 is cooled by circulating air or coolant through the hollow portion by a not illustrated circulation device.

Then, another example of the image fixing apparatus according to the present invention is shown.

FIG. 2 shows an image fixing apparatus according to the invention. The image fixing apparatus shown in FIG. 2 includes a heating roll 1 as a heating member, a pressurizing roll 3 as a pressurizing member arranged in press contact by way of a cooling belt 9 with the heating roll 1, the cooling belt 9, a cooling roll 7 for supporting the cooling belt 9 together with the pressurizing roll 3, a temperature sensor 19 located on the surface of the heating roll 1, a temperature sensor 18 located on the surface of the cooling belt 9, a heating lamp 5 disposed inside the heating roll 1, and a finger 21, in which a fixing nip 27 is formed to a press contact portion by the arrangement in press contact of the heating roll 1 and the pressurizing roll 3 by way of the cooling belt 9.

In the image fixing apparatus shown in FIG. 2, the heating roll 1 rotates in the direction of an arrow A. The pressurizing roll 3, the cooling roll 7, and the cooling belt 9 also rotate in the direction of arrows B, D, and E, respectively.

The heating roll 1 is heated by the heating lamp 5 and the surface temperature of the heating roll 1 is always monitored by the temperature sensor 19 and controlled to a temperature suitable to the fixing of the toner.

The cooling belt 9 is disposed on the surface of the pressurizing roll 3. The cooling belt 9 is cooled by the cooling roll 7. The surface temperature of the pressurizing roll 3 is controlled by the cooling belt 9 to the melting point of the crystalline resin in the color toner +30° C. or lower. In a case where the transportation speed of the transfer medium is 160 mm/sec, the surface temperature is particularly preferably at the melting point of the crystalline resin in the color toner +Y° C. or lower, in which Y is represented by the following formula:

$$Y=0.3X-18$$

where X represents the transportation speed (mm/sec) of the transfer medium of the image fixing apparatus.

Melting of the crystalline resin can be suppressed substantially by controlling the temperature on the surface of the pressurizing roll 3 to the range described above.

The transfer medium 11 having, on one surface, fixed images 17 formed of a color toner for electrophotography and having, on the other surface, unfixed images 15 formed of a color toner for electrophotography is transported by the transportation unit in the direction of an arrow C. The transported transfer medium 11 passes through the fixing nip 27. In this process, the unfixed images 15 are in press contact with the surface of the heating roll 1 heated by the heating lamp 5 and melted. The molten unfixed images 15 are solidified after the passage of the transfer medium 11 through the fixing roll put 27 and then fixed to the transfer medium 11 to form fixed images 17'. Further, since the temperature of the cooling belt 9 disposed on the surface of the pressurizing roll 3 is controlled to the melting point of the crystalline resin in the color toner for electrophotography +30° C. or lower by the cooling roll 7, the fixed images 17 are not substantially melted when the transfer medium 11 passes through the fixing nip 27 and no image failure such as unevenness of gloss does not occur. In a case where the transportation speed of the transfer medium is less than 160 mm/sec, the temperature is, particularly preferably, at the melting point of the crystalline resin color toner +Y° C. or lower in which Y is represented by the following formula:

$$Y=0.3X-18$$

where X represents the transportation speed (mm/sec) of the transfer medium of the image fixing apparatus.

The transfer medium 11 is subsequently discharged by a paper discharging conveyor roll 13.

The materials used for the beating roll 1, pressurizing roll 3 and the cooling roll 7, etc. are identical with those in FIG. 1.

The cooling belt 9 preferably includes a base layer and a releasing layer covered on the surface thereof. The base layer is selected, for example, from polyimide, polyamide and polyamide-imide and the thickness is, preferably, from 50 to 125 $\mu$m. As the releasing layer formed on the surface of the base layer, the fluoro resin as described above, for example, PFA coated to a thickness of 5 to 50 $\mu$m is preferred.

The cooling unit for controlling the surface temperature of the pressurizing member in the invention is not restricted to the cooling roll or the cooling belt as shown in FIG. 1 or FIG. 2. For example, it may also adopt a unit of directly blowing air or the like for cooling to the pressurizing member.

In the image fixing apparatus of the invention, a cleaning member may, optionally, be disposed for removing the toner deposited on the surface of the heating member.

With a view point of improving the durability and the releasability of the fixing member such as the heating member and the pressurizing member, a releasing agent may be applied by a releasing unit 29 (on a heating member) or 29' (on a pressurizing member) to the surface thereof and the application amount is, preferably, from $1.6\times10^{-5}$ to $8.0\times10^{-4}$ mg/cm$^2$.

A smaller application amount of the releasing agent is preferred with a view point of smoothness and gloss of the obtained images. However, if the application amount of the releasing agent is reduced to 0 mg/cm$^2$, the wear amount of the fixing member increases when the fixing member and the transfer medium are in contact with each other during image fixing to possibly lower the durability of the fixing member. Accordingly, the releasing agent is preferably applied by a slight amount to the fixing member with a practical point of view.

When the amount of the releasing agent supplied exceeds $8.0\times10^{-4}$ mg/cm$^2$ (0.5 mg per A4-size sheet), it results in a problem that lowering of image quality occurs remarkably in a case of a transfer medium that utilizes transmitting light such as in an OHP due to the releasing agent remaining on the surface of images after fixing. Further, the releasing agent deposits to the transfer medium to cause sticking. Further, when the amount of the releasing agent supplied increases, the capacity of a tank for storing the releasing agent is also increased to result in a problem of enlarging the size of the image fixing apparatus.

The amount of the releasing agent supplied is measured as described below. That is, when common paper used in usual copying machines as the transfer medium (typically, copy paper manufactured by Fuji Xerox Co., Ltd., trade name of products: "J paper") is passed through the fixing member with the releasing agent being supplied on the surface, the releasing agent deposits on the common paper. The releasing agent on the common paper is extracted by use of a Soxhlet's extractor. Hexane is used for the solvent. By quantitative measurement of the releasing agent contained in hexane by an atomic absorption analyzer, the amount of the releasing agent deposited on the common paper is measured quantitatively. The amount is defined as the amount of the releasing agent supplied to the fixing member.

There is no particular restriction on the releasing agent used in the invention and it can include a liquid releasing agent such as a heat resistant oil, for example, dimethyl silicone oil, fluoro oil, fluoro silicone oil or modified oil such as amino modified silicone oil.

As the releasing agent fluoro oil, fluoro silicone oil, and the like which have high performance but are expensive can also be used with no practical problem in view of the cost since the required amount of the releasing agent supplied may be extremely small.

There is no particular restriction on the method of supplying the releasing agent to the surface of the fixing member in the image fixing apparatus, and the method can include, for example, a pad method, a web method or a roller method using liquid releasing agent impregnated therein or a non-contact type shower method (spray method). Among them, the web method and the roller method are preferred with a view point that the releasing agent can be supplied uniformly and the supplied amount can be controlled easily. For supplying the releasing agent uniformly over the entire fixing member by the shower method, it is necessary to use a blade or the like separately.

The material of the transfer medium used in the invention can include, for example, common paper used in copying machines or printers of electrophotographic systems and OHP sheets. Coated paper formed by coating the surface of the common paper with a resin or art paper for use in printing can be used suitably.

Then, a description is to be made for the color toner for electrophotography according to the invention.

The color toner for electrophotography contains a binder resin that contains a crystalline resin, a colorant and, optionally, other ingredients.

In the invention, "crystalline resin" means a resin having a clear heat absorption peak relevant to the melting point in the differential scanning calorimetry (DSC). Since this is an adhesive ingredient that contributes to the low temperature fixing property of the binder resin, the weight average molecular weight is, preferably, 4,000 or more and, more preferably, 7,000 to 100,000. It is, further preferably, 7,000 or more.

The melting point of the crystalline resin is, preferably, 40 to 120° C. and, more preferably, 60° C. to 90° C.

Since the viscosity of the crystalline resin lowers abruptly when the temperature exceeds the melting point, it causes blocking when stored at higher temperature. This is because the toner tends to deform greatly as a whole to increase the area of contact between each of the toner particles. Then it is necessary that the crystalline resin has a melting point higher than the temperature during storage or use, that is, 40° C. or higher and, preferably, it has a melting point of 60° C. or higher. On the other hand, if the melting point is excessively high, low temperature fixing cannot sometimes be attained.

The melting point can be determined as a melting peak temperature in the input compensation differential scanning calorimetry shown in JIS-K-7121. While plural melting peaks are sometimes shown, the maximum peak is regarded as the melting point.

There is no particular restrictions on the crystalline resin so long as the resin can satisfy the conditions described above, and the resin may be selected properly depending on the purpose and can include, for example, polyolefin resin, polydiene resin, and polyester resin. The resins may be used each alone or two or more kinds of them may be used together. Among them, the polyester resin is preferred in view of easy use.

The polyolefin resin can include homopolymers and copolymers of olefinic monomers and can include, as specific examples, polybutene, poly-3-methyl-1-butene, polypentene, poly-5-methyl-1-hexene, polytetradecene, polypentadecene, polyhexadecene, polyheptadecene, polyoctadecene, polynonadecene, polyeicosene, polycycloheptene-alt-ethylene, and copolymers containing monomer ingredients of the polymers described above.

In the invention, polyolefins of excessively lower melting point or polyolefins of excessively higher melting points, for example, polyethylene or polypropylene can be used also as the crystalline resin by copolymerization with other olefin ingredients or copolymerizing with acrylic acid, acrylate ester, methacrylic acid, methacrylate ester, vinyl alcohol, vinyl acetate, maleic acid anhydride, and the like (specifically, polyethylene ethyl acrylate can be mentioned).

The polydiene resin can include homopolymers and copolymers of the diene monomers and specific examples can include, for example, trans-1,4-poly-1,3-butadiene, cis-2-tertiary butyl-1,4-poly-1,3-butadiene, trans-1-methoxy-1,4-poly-1,3-butadiene, transchloroprene, trans-1,4-polyisoprene, isotactic-trans-1,4-poly-1,3-pentadiene, isotactic-trans-1,4-poly-1,3-heptadiene, isotactic-trans-6-methyl-1,4-poly-1,3-heptadiene, isotactic-trans-1,4-poly-1,3-hexadiene, isotactic-trans-5-methyl-1,4-poly-1,3-hexadiene, trans-erythro-di-isotactic-2,5-poly-2,4-hexadiene, isotactic-trans-1,4-poly-1,3-octadiene, and copolymers of monomer ingredients of the polymers described above.

Specific examples of the polyester resins can include, for example, poly-1,2-cyclopropendimethylene isophthalate, polydecamethylene adipate, polydecamethylene azelate, polydecamethylene oxalate, polydecamethylene sebacate, polydecamethylene succinate, polyeicosamethylene malonate, polyethylene-p-(carbophenoxy)butylate, polyethylene-p-(carbophenoxy)undecanoate, polyethylene-p-phenylenediacetate, polyethylene sebacate, polyethylene succinate, polyhexamethylene carbonate, polyhexamethylene-p-(carbophenoxy)undecanoate, polyhexamethylene oxalate, polyhexamethylene sebacate, polyhexamethylene suberate, polyhexamethylene succinate, poly-4,4-isopropylidenediphenylene adipate, poly-4,4-isopropylidenediphenylene malonate, trans-poly-4,4-isopropylidenediphenylene-1-methylcyclopropane dicarboxylate, polynonamethylene azelate, polynonapethylene terephthalate, polyoctamethylenedodcanediate, polypentamethylene terephthalate, trans-poly-m-phenylenecyclopropane dicarboxylate, cis-poly-m-phenylenecyclopropane dicarboxylate, polytetramethylene carbonate, polytetramethylene-p-phenylene diacetate, polytetramethylene sebacate, polytrimethylene dodecandioate, polytrimethylene octadecanedioate, polytrimethylene oxalate, polytrimethylene undecandioate, poly-p-xylene adipate, poly-p-xylene azelate, poly-p-xylene sebacate, polydiethylene glycol terephthalate, cis-poly-1,4-(2-butene) sebacate, polycaprolactone, and copolymers of the monomer ingredients of the polymers described above.

The content of the crystalline resin in the binder resin is, preferably, from 20 to 50 mass % and, particularly preferably, 20 to 30 mass %. With the content of the crystalline resin in the range described above, a toner excellent in the low temperature fixing property can be obtained.

The binder resin may contain an amorphous resin together with the crystalline resin.

In the invention, "amorphous resin" means a resin which is solid at normal temperature and becomes thermoplastic at a temperature higher than the glass transition point, which shows stepwise change in the heat absorption amount in the differential scanning calorimetry (DSC), different from the distinctive heat absorption peak observed in the case of the crystalline resin described above.

The amorphous resin usable in the invention can include polyamide resin, polycarbonate resin polyether resin, polyacrylonitrile resin, polyallylate resin, polyester resin and styrene-acrylic resin. Among them, the polyester resin is preferred in view of the low temperature fixing property.

The amorphous polyester resin can be prepared usually by polycondensation of a dicarboxylic acid ingredient and a diol ingredient as the monomers.

Specifically, the dicarboxylic acid ingredient is, preferably, terephthalic acid, isophthalic acid, cyclohexane dicarboxylic acid, naphthalene dicarboxylic acid such as naphthalene-2,6-dicarboxylic acid, naphthalene-2,7-dicarboxylic acid, and biphenyl dicarboxylic acid. The diol ingredient is preferably ethylene glycol, propylene glycol, neopentyl glycol, cyclohexane dimethanol, ethylene oxide bisphenol A adduct and trimethylene oxide bisphenol A adduct.

Each of the dicarboxylic acid ingredient and the diol ingredient may be used alone or two or more of them may be used together.

The molecular weight of the binder resin suitable to the invention is about 3,000 to 100,000 in weight average molecular weight Mw. The molecular weight can be measured by a known method and it is generally measured by gel permeation chromatography (hereinafter simply referred to as "GPC"). GPC measurement can be conducted, for example, by use of HLC-802A manufactured by TOYO SODA Co., as the GPC device, under the conditions at an oven temperature of 40° C., a column flow rate of 1 ml/min and a sample injection amount of 0.1 ml, at a sample concentration of 0.5% and using THF for GPC manufactured by Wako Junyaku Co. Further, calibration curves can be prepared, for example, by use of a standard polystyrene specimen manufactured by TOYO SODA Co. The molecular weight and the distribution of the molecular weight were measured by the method described above in the invention.

In addition to the preferred monomers described above, the monomers shown below can also be used together.

The bivalent carboxylic acid can include, for example, dibasic acid such as succinic acid, glutaric acid, adipic acid, suberic acid, azelaic acid, sebacic acid, phthalic acid, malonic acid and mesaconic acid, as well as anhydrides thereof and lower alkyl esters thereof, and unsaturated aliphatic dicarboxylic acids such as maleic acid, fumaric acid, itaconic acid and citraconic acid. Further, the tri- or higher valent carboxylic acids that can be used together in a slight amount can include, for example, 1,2,4-benzene tricarboxylic acid, 1,2,5-benzene tricarboxylic acid, 1,2,4-naphthalene tricarboxylic acid, as well as anhydrides thereof and lower alkyl esters thereof. They may be used each alone or two or more kinds of them may be used together.

Dihydric alcohols can include, for example, bisphenol A, hydrogenated bisphenol A, 1,4-cyclohexanediol, 1,4-cyclohexanediethanol, diethyleneglycol, dipropyleneglycol, 1,3-butanediol, 1,4-butanediol, 1,5-pentanediol, 1,6-hexanediol and neopentylglycol. Further, tri- or higher-hydric alcohols that can be used together in a slight amount can include, for example, glycerin, trimethylol ethane, trimethylol propane and pentaerythritol. They may be used each alone or two or more of them may be used in combination.

With an aim of controlling the acid value or hydroxyl value, a monobasic acid such as acetic acid or benzoic acid or monohydric alcohol such as cyclohexanol and benzyl alcohol can also be used.

The polyester resin used in the invention can be synthesized by selecting and combining preferred monomer ingredients described above and by use of known methods described, for example, in Polycondensation (Kagaku Dojin), High Molecule Experimentology (Polycondensation and Polyaddition: KYORITSU SHUPPAN) or Polyester Resin Handbook (edited by THE NIKKAN KOGYO SHIMBUN) and, specifically, an ester exchange method and a direct polycondensation method can be used each alone or in combination.

There is no particular restriction on the colorant and known colorants can be mentioned and properly selected depending on the purpose. They can include, for example, carbon black, lamp black, aniline blue, ultramarine blue, chalcoyl blue, methylene blue chloride, copper phthalocyanne, quinoline yellow, chrome yellow, dupont oil red, orient oil red, rose bengal, malachite green oxalate, nigrosin die, C.I. pigment red 48:1, C.I. pigment red 57:1, C.I. pigment red 81:1, C.I. pigment red 122, C.I. pigment yellow 97, C.I. pigment yellow 12, C.I. pigment yellow 17, C.I. pigment blue 15:1, and C.I. pigment blue 15:3.

The content of the colorant is, preferably, from 1 to 30 mass parts based on 100 mass parts of the binder resin and a greater amount is preferred within such a range as not deteriorating the smoothness of the image surface after fixing. When the content of the colorant is increased, the thickness of the images can be reduced upon obtaining images at an identical density, which is advantageous in the effectiveness for the prevention of offset. Yellow toner, magenta toner, cyan toner, and black toner can be prepared in accordance with the type of the colorant.

As other ingredients described above, wax can be used as a releasing agent at fixing. The wax include, for example, paraffin wax such as low molecular weight polypropylene or low molecular weight polyethylene, silicon resin, rosin, rice wax and carnauba wax. Among them, those having a melting point of 40° C. to 150° C. are preferred and those having a melting point of 70° C. to 110° C. are more preferred. However, excessive content of the wax may possibly worsen the color image quality and the reliability, such that the wax present on the surface or inside of the color fixing images worsens the projection property of OHP; the wax in the toner transfers by friction to the carrier to change the charging performance of the developer with time in use to a two-component developer, the wax transfers to a charging blade by friction between the toner and the blade to change the charging performance of the developer with time when it is used as one-component developer, and the fluidity of the toner is worsened. The content of the wax is, preferably, from 0.1 to 15%, more preferably, 0.5 to 12% and, further preferably, 0.5 to 10% in the color toner for electrophotography.

In the color toner for electrophotography, various known additives can be used together for the improvement of characteristics within a range not deteriorating the effect of the invention. There is no particular restriction on the additive ingredients and they may be properly selected depending on the purpose and can include, for example, various kinds of additives known per se such as fine inorganic particles, fine organic particles, charge controller and releasing agent.

The fine inorganic particles can include, for example, silica, alumina, titanium oxide, barium titanate, magnesium titanate, calcium titanate, strontium titanate, zinc oxide, silicic sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among them, fine silica particles are preferred and, particularly, fine silica particles put to hydrophobic treatment are preferred. The fine inorganic particles are used generally with an aim of improving the fluidity. The average primary particle size of the fine inorganic particles is, preferably, from 1 to 1000 nm and, particularly preferably, from 10 to 300 nm. The addition amount is, preferably, from 0.01 to 20 mass parts based on 100 mass parts of the color toner for electrophotography.

The fine organic particles can include, for example, polystyrene, polymethyl methacrylate and polyvinyliden fluoride. The fine organic particles are used generally with an aim of improving the cleaning property or transferring property.

The charge controller can include, for example, metal salicylate, metal-containing azo compound, nigrosin or quaternary ammonium salt. The charge controller is used generally with an aim of improving the chargeability.

The color toner for electrophotography can be prepared in accordance with the production process known per se. There is no particular restriction on the production process which can be decided properly in accordance with the purpose. For example, the dry toner production process can include a kneading pulverization method and kneading freeze pulverization method, and the wet toner production process can include, for example, an in-liquid drying method described for example in Japanese Laid Open Patent Application S63-25664, a method of stirring a molten toner under sharing in an insoluble liquid into fine particles and a method of dispersing a binder resin and a colorant in a solvent and then jet spraying them into fine particles.

EXAMPLE

The present invention is to be described specifically with reference to examples but the invention is not restricted by the examples.

(Synthesis of Amorphous Polyester Resin)

In a reaction vessel equipped with a stirrer, a thermometer, a condenser and a nitrogen gas introduction tube, are charged 161.02 mass parts of dimethyl terephthalate, 46.8 mass parts of dodecenyl succinic acid, 5.04 mass parts of trimethyl trimellitate, 113.5 mass parts of 2 mol of ethylene oxide bisphenol A adduct, 260.6 mass parts of polypropylene oxide bisphenol A adduct, 4.34 mass parts of ethylene glycol, and 3.0 mass parts of dibutyl tin oxide as a catalyst and, after replacing the inside of the reaction vessel with a dry nitrogen gas, they are reacted in a nitrogen gas stream, at about 200° C. for about five hours under stirring and then further react under stirring for about five hours while elevating the temperature to about 240° C., to obtain a colorless transparent amorphous polyester resin A.

The amorphous polyester resin A has a molecular weight of Mn 4500 and Mw 3000 by GPC, and a glass transition temperature of 67° C.

The glass transition temperature (Tg) can be measured, for example, by use of a differential scanning calorimeter (DSC 3110, Thermal Analysis System 001: manufactured by Mack Science Co.: hereinafter simply referred to as "DSC") under the condition at a temperature elevation rate of 5° C./min, and the temperature at a shoulder on the low temperature side of a heat absorption point corresponding to Tg of the resultant chart can be determined as Tg. Tg in the invention was measured as described above.

(Synthesis of Crystalline Polyester Resin)

A crystalline polyester resin B is obtained in the same manner as in the synthesis of the amorphous polyester resin from 150 mass parts of ethylene glycol, 200 mass parts of sebacic acid, and 0.2 mass parts of dibutyl tin oxide as a catalyst. Molecular weight measures by GPC was Mn 8000 and Mw 26000, and the melting point is 69.5° C.

(Preparation of Crystalline Resin Containing Toner)

59 mass parts of an amorphous polyester resin A, 30 mass parts of a crystalline polyester resin B, 4 mass parts of a cyan die (Cyanine Blue 4933M: manufactured by Dainichi Seika Co.) as a colorant, and 7 mass parts of carnauba wax are melt kneaded in a Banbury mixer type kneader. The kneading product is molded by a milling roll into a plate shape of about 1 cm in thickness, coarsely pulverize to about several millimeters by a Fitz Mill pulverizer, finely pulverized by an IDS pulverizer and successively classify by an Elbow classifier to obtain a toner. 3 mass % of hydrophobic silica powder (R972, manufactured by Nippon Aerosil Co.) is added to the obtained toner to prepare a toner.

Instead of the cyanine die, a magenta die (Seika First Carmine 1476T-7; manufactured by Dainichi Seika Co.), a yellow pigment (Seiko First Yellow 2400; manufactured by Dainichi Seika Co.), carbon black (Carbon Black #25;

manufactured by Mitsubishi Chemical Co.) are used to prepare a magenta toner, a yellow toner and a black toner, respectively, to obtain a four-full-color toner. The obtained toner containing the crystalline resin is refereed to as a toner AB1.

(Preparation of Amorphous Toner)

89 mass parts of an amorphous polyester resin A, 4 mass parts of a cyanine die (Cyanine Blue 4933M, manufactured by Dainichi Seika Co.) and 7 mass parts of carnauba wax are used to prepare an amorphous toner A1 in the same manner as in preparation for the toner containing the crystalline resin.

(Preparation of Developer)

7 mass parts of the toner AB1 and 93 mass parts of a carrier arc mixed to prepare a developer for electrophotography. As the carrier, a resin-coated type carrier formed by coating a mixture of an amino group-containing vinyl polymer and a fluoro alkyl group-containing vinyl polymer on a ferrite core is used.

(Outline of an Image Outputting Apparatus)

As an image outputting apparatus, an apparatus modified from an image fixing apparatus Acolor 635 (manufactured by Fuji Xerox Co., Ltd.) is used.

Example 1

An image fixing apparatus including a heating roll of 50 mm outer diameter formed by coating a silicone rubber layer of 2.7 mm thickness according to JIS-A 45° on a metal core and having a PFA resin layer of 25 $\mu$m thickness on the surface layer thereof, and a pressurizing roll of 50 mm outer diameter formed by coating a silicone rubber layer of 1 mm thickness according to JIS-A 55° on a metal core and having a PFA resin layer 25 $\mu$m thickness on the surface layer thereof is used and a fixing nip width is set to 6 mm.

A silicone oil is applied to the image fixing apparatus by attaching a silicone oil dip roll to the heating belt, the application amount is controlled by a blade to define the application amount to 0.1 mg per one sheet of A4-size paper ($1.7\times10^{-4}$ mg/cm$^2$). For the measurement of the application amount of the silicone oil, white paper is passed through the image fixing apparatus, the oil-deposited white paper is put to a Soxhlet's extractor and the oil is extracted by use of hexane as a solvent and the amount of the oil is determined quantitatively by an atom absorption analyzer.

As the cooling unit for the pressurizing roll as shown in FIG. 1, a cooling roll driven by a pressurizing roll is used and air is supplied to the cooling roll to control the surface temperature of the cooling roll to a temperature below 95° C., which is the melting point of the crystalline polyester resin +30° C. Cooling is conducted by use of a small sized blower at 24 V DC, 0.13 A (beta SLD08T-24TU24H7 by NIDEC) and blowing air collected by a blower through the cooling roll. Further, the temperature for the heating belt is set to 130° C. Further, a heating lamp of 650 W (100 V) is used for the heating roll.

Black toner, cyan toner, magenta toner and yellow toner are overlaid at a size of 180 mm×50 mm to the top end of color paper manufactured by Fuji Xerox Co., Ltd. (J paper) to fix images at 1.5 mg/cm$^2$ of the toner amount.

The transportation speed of the transfer medium of the image fixing apparatus is set to 160 mm/sec.

Paper passing test is conducted under the conditions described above continuously for 99 sheets and the surface temperature of the pressurizing roll is monitored and the peeling performance is evaluated. The peeling property is evaluated by conducting fixing at the first surface, successively, preparing unfixed images on the rear face, conducting fixing again and visually evaluating the absence or presence of image defects causes by peeling failure on both surfaces.

Comparative Example 1

The cooling unit for the pressurizing roll is detached from the image outputting apparatus of Example 1 and a paper passing test for continuous 99 sheets is conducted in the same manner, the surface temperature of the pressurizing roll is monitored and the peeling property is evaluated in the same manner as in Example 1.

Reference Example 1

The lowest fixing temperature for the amorphous toner A1 and the crystalline resin-containing toner AB1 are compared by use of the image fixing apparatus of Example 1 while changing the temperature of the heating roll. The lowest fixing temperature of the crystalline resin-containing toner AB1 is 95° C. and the lowest fixing temperature of the amorphous toner A1 is 140° C.

(Result of Evaluation)

In Example 1, the surface temperature of the pressurizing roll during paper passing for continuous 99 sheets don't exceed 99.5° C., and the surface temperature of the pressurizing roll immediately after passing the 99 sheets is 95° C., and no image defects caused by peeling arc observed also for the solid images on the rear face.

On the other hand, in Comparative Example 1, the surface temperature of the pressurizing roll after passage of 50 sheets exceeds 100° C., the surface temperature of the pressurizing roll immediately after passing 99 sheets is 115° C. and unevenness in the degree of gloss due to peeling failure is observed for the solid images on the rear face.

Example 2

A test for both-face printing is conducted in the same manner as in Example 1 except for changing the paper transportation speed of the image fixing apparatus to 60 mm/sec and the surface temperature of the pressurizing roll to 65° C.

(Result of Evaluation)

In Example 2, the surface temperature of the pressurizing roll during paper passing for continuous 99 sheets don't exceed 69.5° C., and the surface temperature of the pressurizing roll immediately after passing the 99 sheets is 65° C. and no image defects caused by peeling are observed also for the solid images on the rear face.

Both-face printing with no image defects such as unevenness in the degree of gloss is possible by use of the image fixing apparatus and the image fixing method according to the present invention.

The entire disclosure of Japanese Patent Application No. 2002-207907 filed on Jul. 17, 2002 including specification, claims, drawings and abstract is incorporated herein by reference in its entirety.

What is claimed is:

1. An image fixing apparatus comprising a heating member, a pressurizing member, and a cooling unit which controls a surface temperature of the pressurizing member, wherein a transfer medium having a fixed image formed of a color toner containing a binder resin that contains a crystalline resin and a colorant on one surface thereof and having an unfixed image formed of a color toner containing a binder resin that contains a crystalline resin and a colorant on another surface thereof is passed between the heating member and the pressurizing member to fix the unfixed image, wherein the surface temperature of the pressurizing member is controlled so as to be at a melting point of the crystalline resin +30° C. or lower.

2. An image fixing apparatus according to claim 1, wherein the cooling unit is a cooling roll.

3. An image fixing apparatus according to claim 1, wherein the cooling unit is a cooling belt.

4. An image fixing apparatus according to claim 1, further comprising a unit that applies a releasing agent to surfaces of the heating member and the pressurizing member.

5. An image fixing apparatus according to claim 4, wherein an application amount of the releasing agent is from $1.6\times10^{-5}$ to $8.0\times10^{-4}$ mg/cm$^2$.

6. An image fixing apparatus according to claim 1, wherein the heating member, pressurizing member, or both, has a rubber elastic layer on a metal roll core.

7. An image fixing apparatus according to claim 6, wherein a thickness of the rubber elastic layer is from 0.1 to 3.0 mm.

8. An image fixing apparatus according to claim 1, wherein a melting point of the crystalline resin is within a range from 40° C. to 120° C.

9. An image fixing apparatus according to claim 1, wherein a content of the crystalline resin in the binder resin is from 20 to 50% by weight.

10. An image fixing apparatus according to claim 1, wherein the binder resin contains an amorphous resin.

11. An image fixing apparatus according to claim 1, wherein the surface temperature of the pressurizing member is controlled so as to be at a melting point of the crystalline resin +Y° C. or lower in which Y is represented by the following formula:

$$Y=0.3X-18$$

where X represents a transportation speed (mm/sec) of the transfer medium of an image fixing apparatus, which is less than 160 (mm/sec).

12. A method of fixing an image, comprising the steps of:

fixing a toner image formed on one surface of a transfer medium by an apparatus having a heating member and a pressurizing member, the toner image formed of a color toner containing a binder resin that contains a crystalline resin and a colorant; and fixing a toner image formed on another surface of the transfer medium by the apparatus having the heating member and the pressurizing member, the toner image formed of a color toner containing a binder resin that contains a crystalline resin and a colorant, wherein a surface temperature of the pressurizing member is controlled so as to be at a melting point of the crystalline resin +30° C. or lower.

13. An image fixing method according to claim 12, wherein the surface temperature of the pressurizing member is controlled so as to be at a melting point of the crystalline resin +Y° C. or lower in which Y is represented by the following formula:

$$Y=0.3X-18$$

where X represents a transportation speed (mm/sec) of the transfer medium of an image fixing apparatus, which is less than 160 (mm/sec).

14. An image fixing method according to claim 12, wherein the surface temperature of the pressurizing member is controlled by a cooling roll.

15. An image fixing method according to claim 12, wherein the surface temperature of the pressurizing member is controlled by a cooling belt.

16. An image fixing method according to claim 12, a releasing agent is applied to a surface of the heating member and the surface of the pressurizing member.

17. An image fixing method according to claim 16, wherein an application amount of the releasing agent is from $1.6\times10^{-5}$ to $8.0\times10^{-4}$ mg/cm$^2$.

18. An image fixing method according to claim 12, wherein a melting point of the crystalline resin is within a range from 40° C. to 120° C.

19. An image fixing method according to claim 12, wherein a content of the crystalline resin in the binder resin is from 20 to 50% by weight.

20. An image fixing method according to claim 12, wherein the binder resin contains an amorphous resin.

* * * * *